United States Patent [19]

Stevenson

[11] 4,176,597

[45] Dec. 4, 1979

[54] MANUAL COMPACTOR

[75] Inventor: Grant E. Stevenson, Aurora, Colo.

[73] Assignee: Nelson & Johnson Engineering, Boulder, Colo.

[21] Appl. No.: 823,565

[22] Filed: Aug. 11, 1977

[51] Int. Cl.[2] ..... B30B 1/20

[52] U.S. Cl. ..... 100/244; 100/266; 100/274; 100/289

[58] Field of Search ..... 100/244, 264, 289, 290, 100/266, 255, 274, 275, 276, 277

[56] References Cited

U.S. PATENT DOCUMENTS

| | | | |
|---|---|---|---|
| 547,041 | 10/1895 | Steele | 100/289 |
| 614,804 | 11/1898 | Francis | 100/290 |
| 1,343,872 | 6/1920 | Livering | 100/289 X |
| 3,580,167 | 9/1969 | Simshauser | 100/266 |
| 3,659,520 | 5/1972 | Garrett | 100/266 X |
| 3,908,541 | 9/1975 | Meidell | 100/266 X |

*Primary Examiner*—Billy J. Wilhite
*Attorney, Agent, or Firm*—O'Rourke & Harris

[57] ABSTRACT

A manual compactor having two handles each pivoted at one end for movement through adjacent arcs toward and away from each other, such reciprocating activation motion being translated into rotary motion in a single direction by means of ratchet and pawl arrangements about the pivot shaft of each handle, and thenceforth to rotary motion of opposing screws one each of which is driven by each handle, which in turn act through ball nut structures to forcibly draw together plates with force sufficient for compacting, the handles also having provisions for actuating push rod within the handles for the purpose of disengaging the pawls from the ratchets thereby allowing retraction through spring loading of the plates and repositioning of the apparatus for subsequent compacting.

8 Claims, 4 Drawing Figures

MANUAL COMPACTOR

BACKGROUND OF THE INVENTION

The invention described herein was made in performance of work under NASA Contract Number NAS 9-14686 and is subject to the provisions of Section 305 of the National Aeronautics and Space Act of 1958 (72 Stat 435; 42 U.S.C. 2457).

FIELD OF THE INVENTION

The present invention relates generally to manual compacting devices, and more particularly to an improved and particularly advantageous apparatus for conversion of manually generated opposing rotational force to linear force and the application of such force to material to be compacted.

DESCRIPTION OF THE PRIOR ART

Compacting devices, by reason of their value in situations as diverse and varied as reducing the volume of trash and garbage, extracting juices from fruits and vegetables, and converting crops such as cotton and hay into easily managed bales, have been known and used for some time. Various arrangements have been suggested, most employing mechanical advantage achieved by use of the screw and nut principle whereby lienear force is generated through application of rotary motion to the screw. Descriptions of the basic screw operated press are contained in U.S. Pat. No. 304,594, issued Sept. 2, 1884, and U.S. Pat. No. 547,041, issued Oct. 1, 1895. Certain details in these patents are, in fact, common to most subsequent devices for the application of compacting force, most notably the ratchet and pawl arrangement through which the screw is operated. U.S. Pat. No. 614,804, issued Nov. 22, 1893, concerns a device for the purpose of allowing the ratchet operation of screws in either direction, such that the screw may be fully rotated while the ratchet handle is moved back and forth through an arc less than a full revolution.

Although previously suggested means for the application of compacting force work well in some circumstances, most require solid mountings and heavyweight castings and members to opposite forces generated during operation. The input forces through a lever, wheel or other such mechanism are conventionally counteracted by the mass or mounting of the compactor device. The need for strength in the apparatus often makes portability an impossibility.

SUMMARY OF THE INVENTION

The present invention, which provides a heretofore unavailable improvement over previous manual compactors, comprises a compactor in which operating forces are applied through leverlike handles connected by ratchet means to bevel gears which in turn transmit the force through ball screws and ball screw nuts to pressure plates. Because the operating handles move inwardly, toward one another, on the compacting stroke, applied forces are substantially balanced and the need for fixed mounting of the apparatus and heavyweight construction is significantly decreased. Anti-slip support or light clamping suffice to offset uneven application of force through the handles.

Accordingly, an object of the present invention is to provide a new and improved means for the application of compacting force between moving pressure plates wherein manual movement of handles is translated from rotary motion to linear motion by action of ball screws and ball screw nuts.

Another object of the present invention is to provide a new and improved structure for the application of compacting force generated by manual means wherein construction of the apparatus, by reason of the counteraction of forces involved, may be lightweight and portable.

Yet another object of the present invention is to provide a new and improved structure for manual compacting of diverse materials in which the application of operating force does not have the effect of causing the apparatus to move about in its entirely due to substantial unbalanced forces, thereby allowing the apparatus to be of lightweight construction and operable without permanent mounting to a work surface.

These and other objects and features of the present invention will become apparent from the following description.

DETAILED DESCRIPTION OF THE INVENTION

Figure 1:
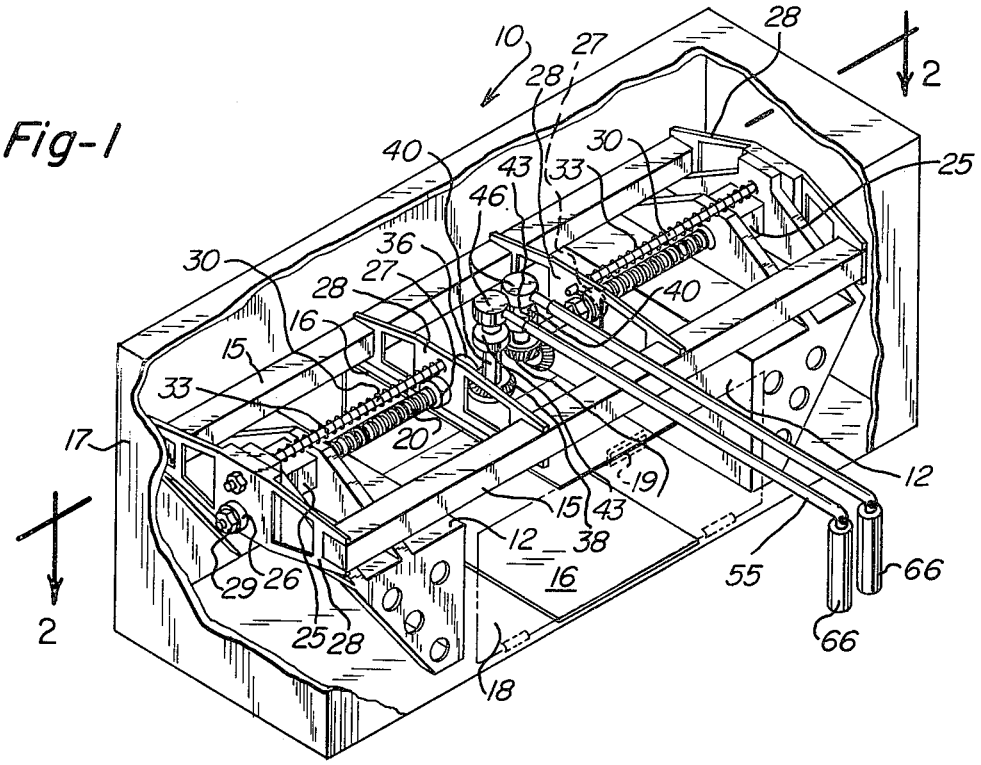
FIG. 1 is a front perspective view of a manual compactor according to the instant invention, with portions of the enclosure cut away to reveal construction.
Figure 2:
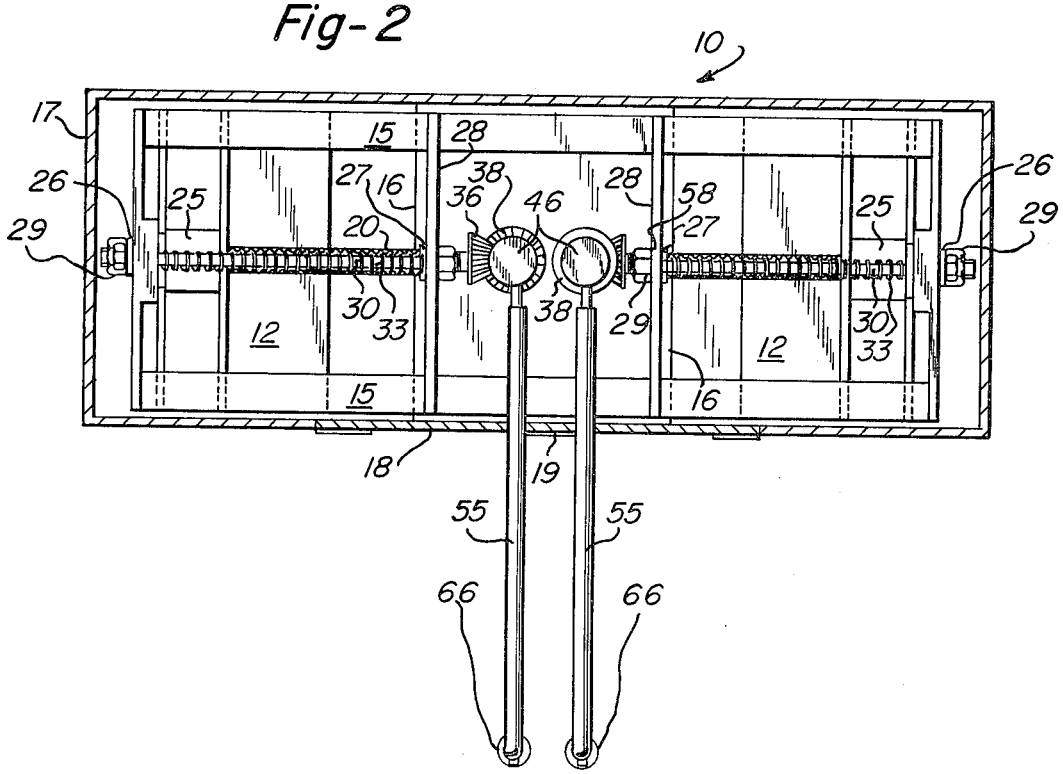
FIG. 2 is a top, sectional view along line 2—2 of the manual compactor of FIG. 1.

Referring now to the drawings, wherein like components are designated by like reference numerals throughout the various figures, a manual compactor according to the instant invention is shown in FIGS. 1 and 2 and designated by reference numeral 10. Manual compactor 10 is primarily formed of, preferably, a lightweight metallic alloy such as aluminum.

As illustrated, compactor 10 is comprised of pressure plates 12, fabricated preferably in buttressed form so as to be capable of transmitting force sufficient for compacting, and slidably bearing against support structure 15 for linear movement toward or away from one another. Containment member 16 is positioned to receive pressure plate 12 at the portions of travel thereof which generated the greatest compacting pressures. Pressure plates 12 and support structure 15 are totally within enclosure 17, which is preferably formed of a suitable lightweight sheet metal (plastic or other such material), with the space directly between the compression faces reachable through hinged access door 18, fitted with a suitable latch 19. Access door 18 is of reinforced construction and cooperates with containment member 16 to provide a defined, structurally strong volume configured to receive pressure plate 12. The area in which compacting force is applied is thus defined by containment member 16 at the top, bottom and back, access door 18 in front, and pressure plates 12 at either end.

Linear compacting movement of pressure plates 12 is effected by the low friction action of conventional ball screw nuts 25. Mechanical action in this portion of the device is effectively the same for both left and right sides and therefore will be described only once. Ball screw nuts 25 are positioned at and secured by the upper structure of pressure plates 12 such that the transfer of linear motion is parallel with the longitudinal axis of ball screws 20, and directly to pressure plates 12. Screws 20 are positioned within enclosure 17 by suitable bearings 26 and 27 fixed to crossmembers 28 of support structure 15.

Screws 20 are free to rotate within the bearings 26 and 27 while being held in position laterally by locknuts. By reason of the mechanical action of the screw thread against ball screw nut 25, as shown in detail in FIG. 3, rotational movement of screws 20 is converted to linear motion of ball screw nuts 25 and thence to pressure plates 12. Guide rods 30, oriented with major axes parallel to the major axes of screws 20 and firmly fixed to crossmembers 28 of support structures 15, align with and pass through suitably positioned holes in the upper portion of pressure plates 12 and serve to maintain pressure plates 12 in alignment with respect to one another and, in conjunction with screws 20 define the path of travel of pressure plates 12. Compression springs 33, fitted over guide rods 30, serve to apply retractional force to pressure plates 12; that is, extension of springs 33 tends to cause plates 12 to move away from each other thereby repositioning plates 12 for the insertion of additional material therebetween.

Rotational motion of screws 20, and therefore eventual linear compressional movement of pressure plates 12, is a result of rotational input to screws 20 through bevel gears 36. The single exception to the mirror image mechanical operation of compactor 10 occurs in this gear power transmission section. Bevel gears 36 mesh with bevel gears 38 which, as a result of features to be described below, rotate in opposite directions. In order to impart this counterdirectional motion to screws 20, thereby effecting opposing linear motion to pressure plates 12 through ball nuts 25, bevel gears 36 and 38 on one side of compactor 10 are set to mesh below the center line of screw 20 while bevel gears 36 and 38 on the opposite side are aligned to mesh at a point above the center line of the screw 20. Counter-rotational movement is thereby conserved and translated into opposing linear movement of pressure plates 12.

Figure 4:
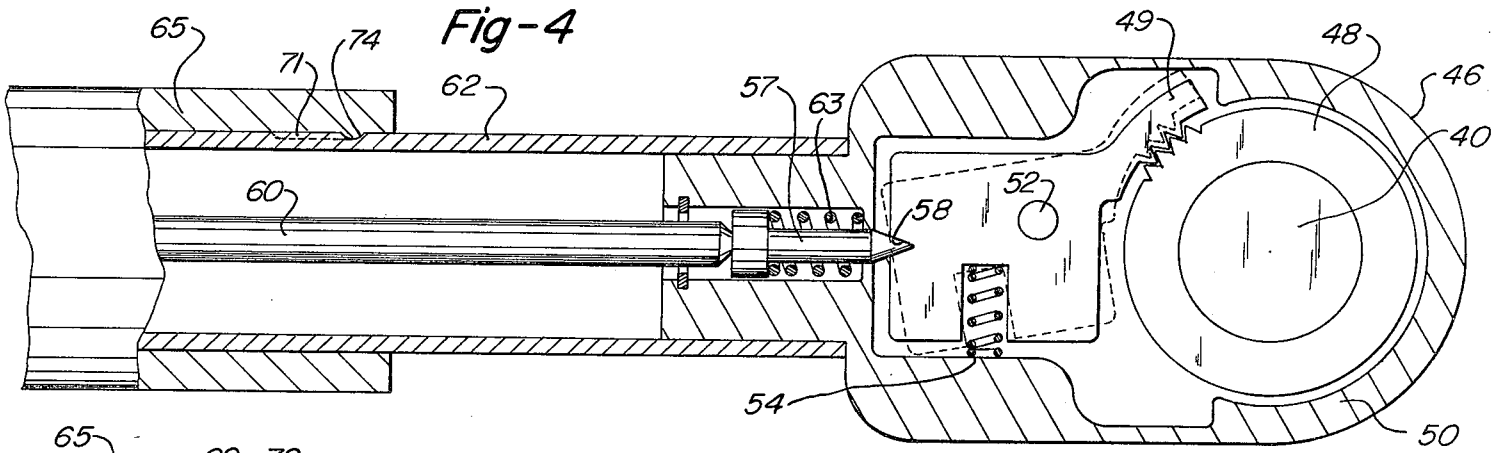
FIG. 4 is a partially sectioned side view of the ratchet assembly and handle member.
Figure 3:
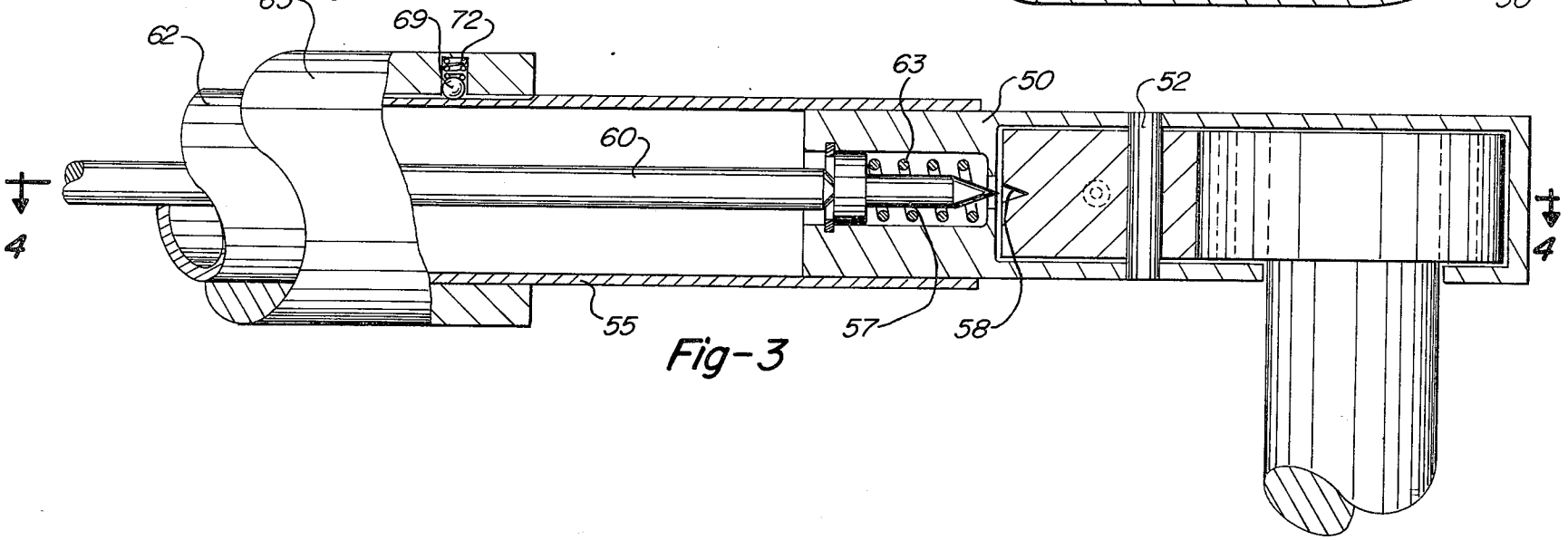
FIG. 3 is a partially sectioned top view of the ratchet assembly and handle member.

Bevel gears 38 are journalled on shafts 40, turning within bearings 43 fixed to enclosure 17. The upper ends of shafts 40 terminate in ratchet assemblies 46, as shown in FIGS. 3 and 4.

Ratchet assemblies 46, being mirror images of one another, are comprised of ratchet gears 48, firmly fixed to shafts 40 at their upper ends, and pawls 49 positioned as to act upon gears 48, causing them to revolve. Pawls 49 are enclosed in housings 50, positions to freely revolve about ratchet gearts 48. Pawls 49 are pivotally mounted on shafts 52, journalled in housings 50 such that their major axes are parallel with the major axes of ratchet gears 48 and shafts 40. Pawls are normally held in engagement with ratchet gears 48 by action of spring 54, which cause pawls 49 to rotate about shafts 52. With pawls 49 in the meshed position with ratchet gears 48, lateral force applied in one direction to the handles 55 of the ratchet assemblies 46 is carried through pawls 49 and gears 48 to produce rotational movement of shaft 40. Movement of handles 55 in a direction opposite to the operating direction results in disengagement of the pawls 49 from the ratchet gears 48 by reason of the positioning of pivot shafts 52 and the compression of spring 54.

Means for totally disengaging pawls 49 from gears 48 in order to facilitate unhindered movement of pressure plates 12 is made possible by the action of release pin 57 on pawls 49. Release pin 57, having a conical point at one end and slidably mounted within housing 50, is located so as to contact and fit within a suitably shaped depression 58 in pawl 49 when linear force is applied to pin 57 urging it generally toward the center of gear 48. By reason of the location of pivot shafts 52 in relation to depression 58, movement of the release pin 57 into depression 58 and subsequent applied force translates to rotational force and causes pawls 49 to rotate about shafts 52 and disengage from gear 48.

The linear force which urges pins 57 toward the center of gears 48 to effect disengagement of pawls 49 from gears 48 is supplied to the pin through push rods 60, located substantially concentrically within inside handle members 62, which are preferably of tubular form. Push rods 60 are free to move linearly within handle members 62 and positioned to engage release pins 57 and displace pins 57 toward gears 48 for engagement at depressions 58 and rotation of pawls 49 out of engagement with gears 48. Release pins 57 are held in a normal retracted position by compression springs 63 until acted upon by push rods 60.

Actuation of push rods 60 within housings 62 is accomplished through the attachment of rods 60, at their ends opposite the ends in contact with release pins 57, to outer handle members 65. Outer handle members 65, preferably having grasping portion 66 bent at a suitable angle for manual operation, are formed of tubular material and have an inside diameter suitable for engagement in telescope fashion, of inner handle members 62. Outer handle members 65 are capable of assuming two positions: i.e., extension during compacting operation of the compactor ratchet and pawl drive system thus offering maximum leverage for application to pawls 49 and allowing release pin 57 to remain retracted by reason of force applied to it by compression springs 63; and retraction during retraction of pressure plates 12 at the completion of the compacting operation, thereby causing push rods 60, attached to handle members 65, to move into contact with release pins 57 and urge the pins into depressions 58 in pawls 49, causing rotation of pawls 49 about pivot shafts 52 and subsequent disengagement of pawls 49 with gears 48 and thereby allowing retractional movement of pressure plates 12. In the preferred embodiment handle members 65 are positively located in either extended or retracted position by ball detents 69, shown at inward position in FIG. 3, which are urged into firm contact with raceways 71 on inner handle members 62 by compression springs 72. Raceway 71 is formed so as to provide suitable depressions 74 to define maximum travel of member 65 and to hold member 65 firmly in either fully retracted or fully extended position. Similar arrangements (not shown) are provided at the extended position of handles 65.

In operation, after material to be compacted is placed inside enclosure 17, and preferably within a reinforced bag within enclosure 17, manual force is applied to the compactor via extended and locked members 65. Movement of handle members 65 through an arc toward each other is translated, by means of pawls 49 and ratchet gears 48 into rotary motion of shafts 40. The resultant force is carried by shafts 40, on which ratchet gears are journalled. Bevel gears 38, fixed on shaft 40 and meshed with bevel gears 36, fixed upon the ends of screws 20, transfer the rotary motion to the screws 20, thus causing screws 20 to generate linear force at ball screw nuts 25. Linear movement of ball screw nuts 25 urges pressure plates 12, firmly connected to ball screw nuts 25, to move toward each other, thereby generating compacting pressure between the plates and inside enclosure 17.

Following the application of manual force on handle members 65 and the movement of the handles together, a counter force on the handle causes pawls 49 to rotate about shafts 52, compress springs 54, and disengage from ratchet gears 48. This disenagement allows handle member 65 to be manually returned to the position for application of additional force. Subsequent inward pressure upon handle members 65 causes pawls 49 to rotate in the opposite direction about shafts 52 and engage once again ratchet gears 48, allowing the manual input movement again to be translated to compacting force on pressure plates 12.

When sufficient force has been applied through the ratchet operation of handle members 65 to compact the material placed within enclosure 17, handle members 65 are slidably moved along inner handle members 62 toward ratchet assemblies 46, thereby causing connected pushrods 60 to contact and urge inward release pins 57. Release pins 57 then engage pawls 49 at depressions 58, causing the pawls to rotate about shafts 52 and disengage from ratchet gears 48. Disengagement of pawls 49 from ratchet gears 48 allows free rotation of screws 20 and, subsequently, free linear motion of pressure plates 12. Linear force then applied to the pressure plates by compression springs 33, fitted over guide rods 30, causes plates 12 to move away from each other, readying the area between them for yet another cycle of compacting.

Although only preferred embodiments of the present invention have been illustrated and described, it is anticipated that numerous changes and modifications will be apparent to those skilled in the art, and that such changes may be made without departing from the scope of the invention as defined by the following claims.

What is claimed is:

1. A manual compactor comprising;

an enclosure having a door defined therein;

an elongated support structure positioned within the enclosure;

a pair of pressure plates having face portions, the pressure plates being slidably mounted for reciprocal movement relative to support structure with the face portions opposing one another;

a pair of screw members rotatably mounted to the support structure with one screw member adjacent each pressure plate;

a pair of nut members secured one each to each pressure plate and each engaging a screw member;

a pair of elongated handles rotatably mounted adjacent one another; and ratchet means and drive means connecting the handle members through the drive means to the screw members, the screw members, nut members, ratchet means and elongated handles being arranged to move the pressure plates together when the handles are moved with opposite rotational sense;

whereby the rotation of the handle members rotates the screw members through the drive means and moves the pressure plates forcefully together.

2. A manual compactor as set forth in claim 1 in which the nut members are ball nuts having therein ball rollers configures to engage the screw members.

3. A manual compactor as set forth in claim 2 in which return springs are positioned between each pressure plate and the support structure to bias the pressure plate to a spaced apart relationship.

4. A manual compactor as set forth in claim 3 in which the ratchet means include ratchet release means to disengage the ratchet means thereby alowing the return springs to position the pressure plates in a spaced apart relationship.

5. A manual compactor as set forth in claim 1 which includes a reinforement member positioned within the inclosure adjacent the door thereof and extending around the enclosure at the bottom, side opposite the door, and upper portions, the reinforcement member being a three sided structure of sufficient dimension to permit the face portions of the pressure plates to move therein.

6. A manual compactor comprising;

an enclosure having a door defined therein;

an elongated support structure positioned within the enclosure;

a pair of pressure plates slidably mounted for reciprocal movement relative to the support structure and having face portions arranged in opposing relationship;

a pair of compression springs positioned one each between each of the pressure plates and support structure;

a pair of screw members rotatably mounted to the support structure and positined one each adjacent each of the pressure plates;

a pair of ball nut members attached one each to each of the pressure plates and engaged with each ball screw member engaging the screw member adjacent each corresponding pressure plate;

a pair of ratchet means each having a release means therein;

a pair of elongated handles attached one each to each ratchet means;

drive means connecting the ratchet means to screw members; and a reinforcement member positioned within the enclosure adjacent the door, the reinforcement member being a three sided structure extending adjacent the path of travel of the pressure plate at the bottom, side opposite the door and upper portion of such path of travel.

7. A manual compactor as set forth in claim 6 in which a pair of guide rods are included in the support structure and connected thereto, and each pressure plate is slidably mounted on a guide rod with said compression springs also positioned one each on each guide rod between the pressure plate and the support structure.

8. A manual compactor as set forth in claim 7 including telescoping handles operably connected to the ratchet means to release the ratchet means upon telescoping of the handles.

* * * * *